United States Patent [19]

Toms

[11] 4,222,122

[45] Sep. 16, 1980

[54] BOXING HEADGUARD

[75] Inventor: John L. Toms, Bellport, N.Y.

[73] Assignee: Everlast World's Boxing Headquarters Corp., Bronx, N.Y.

[21] Appl. No.: 960,925

[22] Filed: Nov. 15, 1978

[51] Int. Cl.³ ..... A42B 1/08; A63B 71/10

[52] U.S. Cl. ..... 2/9; 2/424; 2/425

[58] Field of Search ..... 2/410, 425, 6, 424, 2/9

[56] References Cited

U.S. PATENT DOCUMENTS

| | | | |
|---|---|---|---|
| 1,514,516 | 11/1924 | Golomb | 2/9 |
| 1,517,886 | 12/1924 | Austin | 2/9 |
| 1,716,550 | 6/1929 | Hart | 2/9 |
| 1,759,738 | 5/1930 | Erario | 2/9 |
| 3,594,815 | 7/1971 | Reese | 2/425 X |

*Primary Examiner*—Louis Rimrodt
*Attorney, Agent, or Firm*—J. David Dainow

[57] ABSTRACT

A laceless boxing headguard having a front panel, side panels including ear protectors extending from each side of the front panel, a wide band of elastic extending across the rear of the headguard between and connecting the rear edges of the side panels, and inelastic adjustable belt also extending between and connecting the rear edges of the side panels, and an adjustable and relatively inelastic web spanning the top of the headguard between the front panel and rear band and laterally between the side panels.

7 Claims, 8 Drawing Figures

10
11
13
14
15
16
17
18
18A
19
20
23
24
25

BOXING HEADGUARD

BACKGROUND OF THE INVENTION

Boxing headguards or training headguards are widely used and usually required in boxing activities, which include individual fights, tournaments, training sessions and physical fitness programs at high school, collage, amateur, and professional levels.

These headguards vary mainly in regard to the amount and placement of padding, the weight, and the adjustability. A typical headguard is a type of helmet having padding positioned to protect various parts of the face and head, especially the forehead, temples, eyebrows, and ears; additional padding may be added to protect the cheeks, jaw, chin, and back of the head.

In a typical headguard there are the various padding components, laces, straps and buckles to adjust the size and shape of the headguard to conform as well as possible to the shape and size of the boxer's head and to secure the headguard firmly and reliably on the boxer's head, and soft but firm inner lining to provide as much comfort as possible. Obviously a single headguard could be custom-made and custom-fit onto a particular boxer's head, and all the above objectives could be optimized. However, in most gymnasiums and athletic programs a collection of large medium, and small headguards are available to be used by dozens or hundred of fighters, and even with the size adjustments of each headguard, the great variations of head sizes and shapes results in a vast number of imperfect fits. From poor fits there will be lack of comfort and/or lack of sufficient snugness to prevent rotation or tipping of the headguard relative to the head from the blows which may come from random angles.

The means for attaching and adjusting a typical headguard consists of a chin strap extending between the bottom edges of the two sides, and laces extending from the adjacent edges of two rear panels which may or may not include additional elastic. In some prior art headguards the web across the top consists merely of flexible strips of fixed length for establishing maximum size; in another prior art headguard loops extend upward from the top edges of the front, side and rear panels, and a lace is threaded through the loops. Tightening the lace forms the tops of the loops into a smaller circle which reduces the upper part of the headguard generally uniformly in both lateral and height dimensions.

In all versions, lacing up and later unlacing the rear panels is time consuming for the trainer in charge of preparing the fighters and difficult or impossible for the boxer to do properly by himself. Particularly in boxing tournaments where many fights are scheduled, one-after-another, and a subsequent fight cannot begin until a headguard is removed from one fighter and secured on another fighter, the lacing and unlacing exercise delays all persons involved; because of their haste to begin each fight, trainers and/or boxers may not devote enough time and attention to lacing to provide the most safe and comfortable fit.

As indicated earlier with these typical prior art headguards, lacing the rear and/or top is rarely likely to produce a good or perfect fit, because while the leather and foam construction is very flexible, it cannot possibly conform to all heads. Consequently, the headguard may be sufficiently tight to resist tipping in a side-to-side motion, but is subject to tipping in a front-to-rear direction or vice versa. A loose headguard is undesirable for many reasons including reduced safety, and possible reduced comfort and visibility. The new invention assures an excellent fit in regard to safety and comfort for substantially all users, and it achieves this high degree of adjustability with a fraction of the time and effort required in all known prior art headguards as will be described below in the Summary of the Invention and the Detailed Description with reference to the attached drawings.

SUMMARY OF THE NEW INVENTION

The new headguard has a front pad for protecting the forehead, side panels including ear protectors extending rearward from the front pad, and a single, continuous elastic band extending between and connecting the rear edges of the side panels. This rear band is stretchable in its length direction between the side panels and is relatively inelastic in the height direction. An adjustable, inelastic belt also extending between the two side panels, overlies the rear band. Preferably this belt is formed of two parts having mating VELCRO ®fastening surfaces which can connect the belt parts regardless of the total length they define. A flexible web located at the top of the headguard is shaped as a cross which has a transverse strip extending between the top edges of the side panels, and a longitudinal strip extending from the front pad rearward to and overlying the rear band. The free end portion of this longitudinal strip and the center part of the rear band also having mating VELCRO fastening surfaces.

In using this new headguard the open bottom part is placed over the boxer's head, and the rear band is stretched to accomodate whatever is the shape and size of the head. The wide elastic band provides an effectively perfect and comfortable fit around the back of the head; the inelastic rear belt or straps are then extended about the rear of the head, and adjusted to establish the desired amount of tightness of the headguard in the circumferential direction, and these straps are then instantly, releasably secured together by the VELCRO fastening surfaces.

Finally the inelastic longitudinal strip is pulled rearward until the desired tightness is achieved in the front-to-rear direction across the top of the headguard; with this selected tension established the VELCRO fastener surface on the end of the longitudinal strip is contacted against the mating VELCRO fastener surface on the rear band, resulting in instant releasable attachment. Before or after the above fitting and fastening, the chin strap is adjusted and secured. With these features the headguard is snug, comfortable, well-fitted to provide adequate padding adjacent the areas to be protected, and the headguard is secured from slipping, twisting or otherwise moving to an altered position relative to the fighter's head, except for minor and momentary movement when the headguard is struck during a fight and the padding compresses and resiliently expands.

The rear band is a broad strip of elastic fabric that engages the rear of the head above and below the convex projection of the head extending rearward. The rear belt is situated near the lower-most part of the rear band, near the boxer's neck; tightening of this belt will effectively lock the headguard from tipping forward, while securing the chin strap prevents tipping backward. The rear belt in combination with the chin strap also precludes rotational movement of the headguard in the circumferential direction. Finally, the strap extending from the web rearward to the rear band takes up any slack in the front-to-rear direction after the chin strap and rear belt are secured. Front-to-rear slack is frequently encountered, because the front-to-rear head dimension is one of the most significant variables in head size and shape. Known prior art headguards have no structural component to deal solely and effectively with this slack problem, and no apparent evidence of having identified same as a problem.

The present invention disclosed herein utilizes a combination of new approaches for providing a headguard that is more effective for its intended purposes and therefore more practical than previous headguards. Details of the preferred embodiment of this laceless, fast-fitting and reliable headguard are provided below with reference to the drawings as described.

DETAILED DESCRIPTION OF THE PREFERRED EMBODIMENT

Figure 2:
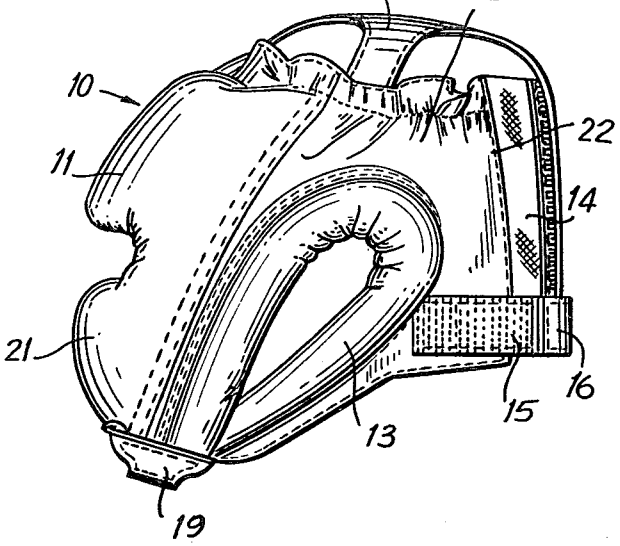
FIG. 2 is a side elevation view thereof.
Figure 3:
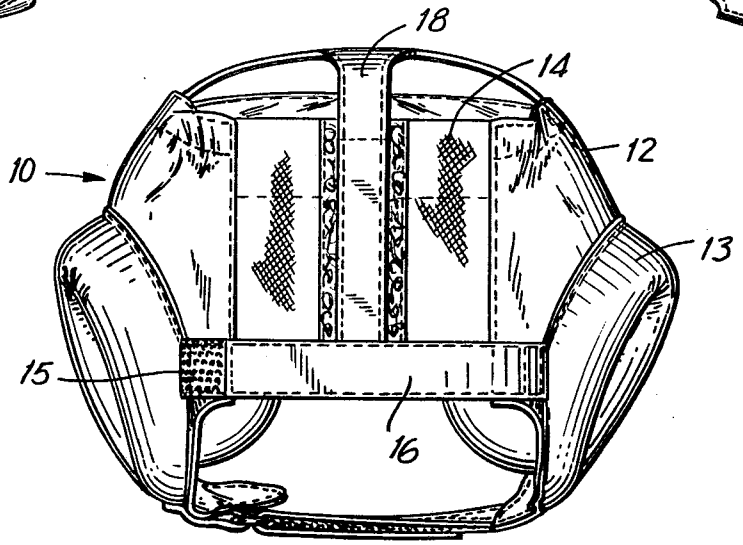
FIG. 3 is a rear elevation view thereof, with the belts engaged.
Figure 1:
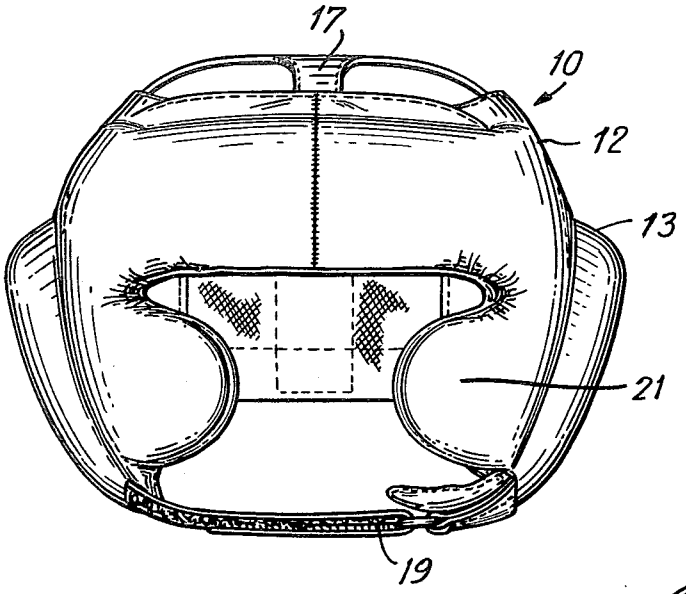
FIG. 1 is a front elevation view of the new headguard.
Figures 4, 5, 6:
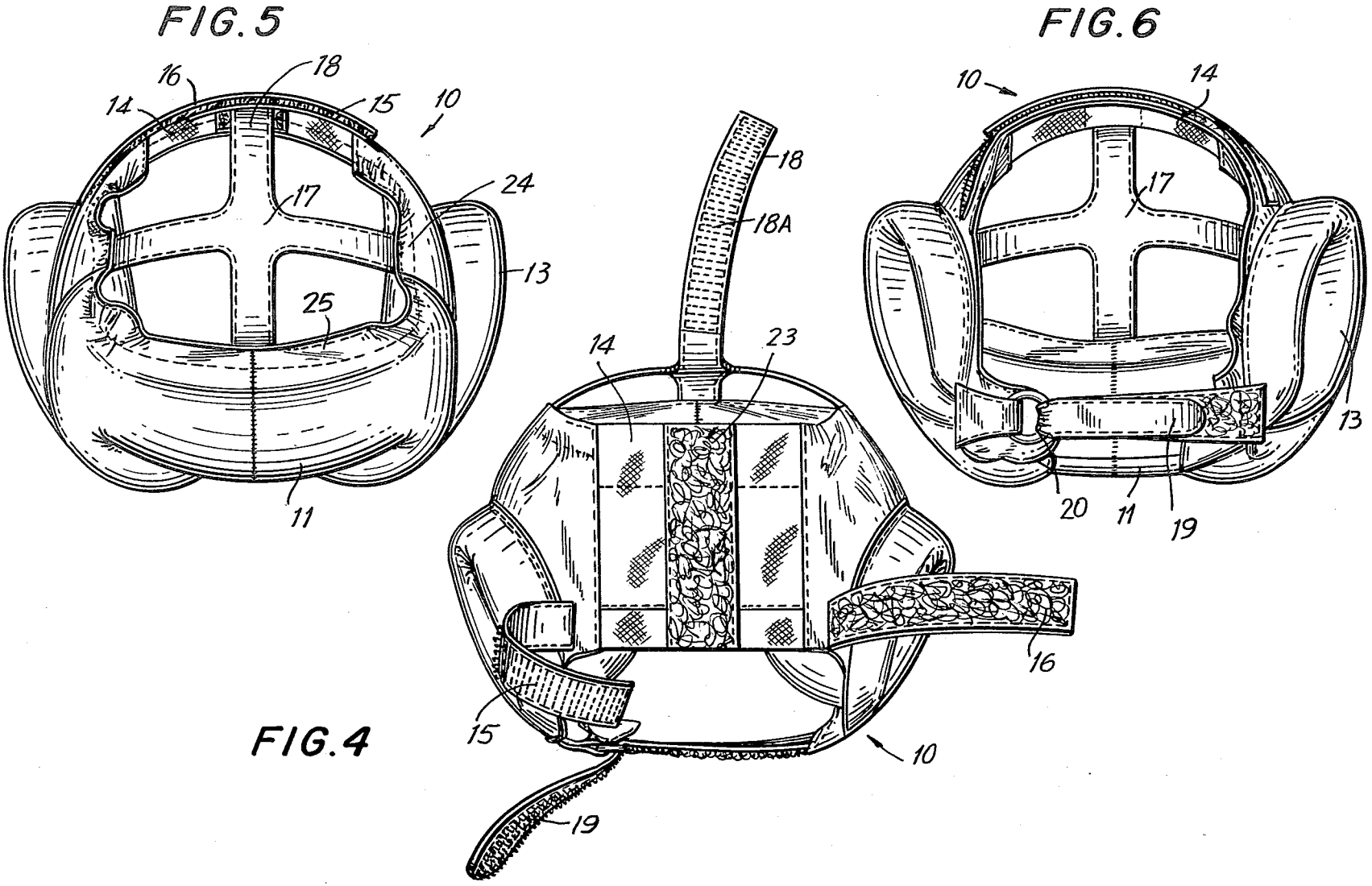
FIG. 4 is a rear elevation view thereof with the belts disengaged.
FIG. 5 is a top plan view thereof.
FIG. 6 is a bottom perspective view thereof.

The new invention is shown in FIGS. 1–8 which illustrates the new headguard 10 and its relevant structural features. The basic components are the padded front panel 11, side panels 12, ear protectors 13, rear elastic band 14 made of shoe gore or similar material, first rear belt 15, second rear belt 16, top web 17, top belt 18, chin strap 19, chin strap buckle 20, and cheek tabs 21.

Essentially the entire headguard structure is leather-lined inside and outside, although other durable materials may be used, so long as the exposed surfaces are smooth to avoid irritating the user's skin and to avoid cutting or otherwise damaging the opponent's boxing gloves. The front panel 11 for protecting the forehead and the cheek tabs 21 (which are optional) are filled with thick, foam padding; the ear protectors 13 secured to and made a part of the side panels are each filled with similar padding which is shaped to protect the ears while allowing a clear center space to avoid interference with normal hearing.

Certain structural aspects of this headguard are similar to ones found in the prior art, namely the general construction, the composition and location of padding, the inner and outer skins or covering, stitching, and the general shape. For example, known padding has included open cell soft or medium polyvinyl chloride foam or RUBATEX ®grade SCE-41; the covering is typically leather or vinyl; stitching may be soft nylon thread; significant novelty lies in the introduction and function of a variety of new structural elements, namely the new laceless rear band 14, the inelastic rear belts 15 and 16, the new web 17 with its inelastic top belt 18, and the VELCRO fastener material as described below in greater detail.

The elastic band 14 extends between and is attached as by sewing, to the rear edges 22 of the side panels 12. This band is stretchable in the transverse direction between the side panels, which will also be defined as the circumferential direction around the back of the boxer's head; the band is relatively inelastic in the vertical or height direction, i.e. from top-to-bottom when the headguard is oriented in its upright position. The height dimension is preferably from 4 to 6 inches in order to overlie a major portion of the rear of the boxer's head, including the convex rearward projection of the head and the inward curved area at the base of this projection and the upper part of the neck. Extending down the middle of band 14 and sewn thereon is a strip of VELCRO ®fastener material 23, whose purpose will be explained later.

Non-stretchable or essentially inelastic straps 15 and 16 extend from the rear edges 22 of the two side panels 12; the free ends of these belts have on their respective surfaces mating VELCRO fastener material 15A and 16A. The top web 17, shown most clearly in FIG. 5, defines a cross of soft leather, with three of the four ends of the cross secured respectively to the top edges 24 of the two side panels 12 and the top edge 25 of front panel 11. The free fourth end of the cross of web 17 extends a considerable length in the rearward direction as top belt 18 which has sewn on its bottom surface a strip of VELCRO fastener material 18A for mating with the VELCRO strip 23 on the outer surface of rear band 14.

Figure 8:
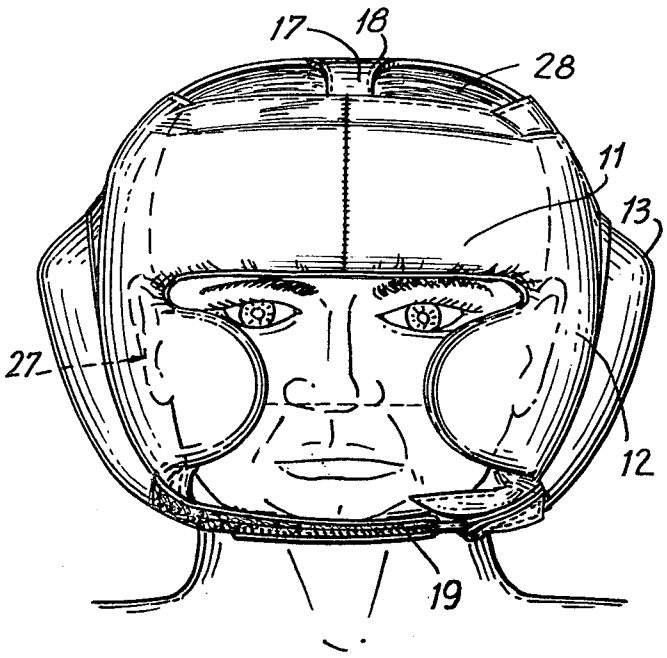
FIG. 8 is a front elevation view similar to FIG. 7.
Figure 7:
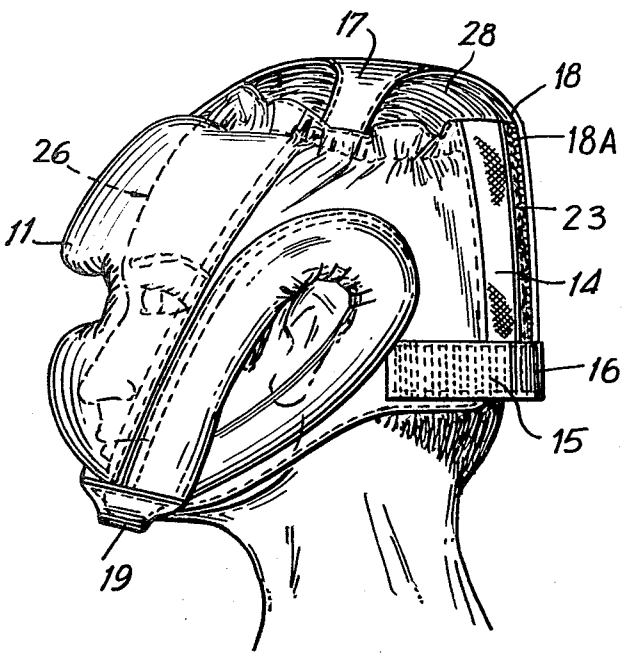
FIG. 7 is a schematic side elevation view of the new headguard positioned on a person's head.

In using this headguard a boxer will place the open bottom end over his head and pull downward, as appears in FIGS. 7 and 8, until front panel 11 rests on his forehead 26 and the ear projectors 13 are positioned to comfortably overlie the ears 27. The rear band 14 must be stretched until it is pulled down along the back of the head 28, and because of the elasticity this band will comfortably and firmly conform to essential the entire convex and adjacent surfaces 29 of the rear of the head. next the rear belts 15 and 16 are tightly overlapped and upon contact their mating VELCRO surfaces 15A and 16A instantly and securely but releasably engage. The elastic band 14 stretches to conform to the curcumferential dimension of the head; then the inelastic rear belts overlie the stretched band 14 and when coupled together establish a fixed maximum circumferential dimension that prevents further stretching of band 14 and thus restricts loosening or rotation of the headguard relative to the boxer's head. It is also possible for the rear straps 15 and 16 to be overlapped to define a length less than the normal, unstretched width of the rear band if the headguard were too large for the boxer's head. This would wrinkle the rear band, but nevertheless secure the headguard on the boxer. The chin strap 19 when secured prevents the headguard from tipping rearward when struck, and the rear belts 15 and 16 coupled below the convex projection 29 of the rear of the head prevent the headguard from tipping forward.

Finally the top belt 18 is pulled rearward and downward to overlie the rear band 14 and then the strips of mating VELCRO fastener material 18A and 23 respectively on top belt 18 and rear band 14 are pressed together and instantly, releasably engaged. This last adjustment eliminates slack in the web in the front-to-rear direction, and urges the top edge of the rear strap 14 downward against the scalp to further reduce slack if the band did not fully conform to the boxer's head. This coupling of the top belt to the rear strap also fixes the front-to-rear circumferential length from chin strap or from the front panel to the rear strap, which adds to overall snugness of fit and ultimate safety in use of this athletic equipment.

As a described above the new laceless headguard permits extremely fast and accurate fitting of the headguard onto the boxer's head; also this headguard assures reasonable comfort and high reliability that the correct tightness was achieved and will remain even when the headguard is subjected to the normal blows during a fight.

The above-described headguard structure is presented only as a preferred embodiment, with the understanding that there may be many variations in structure withih the scope and spirit of this invention as defined in the appended claims.

What is claimed is:

1. In a headguard including a padded front panel having upper and lower parts, side panels extending rearward from the front panel, each side panel having upper, rear, and lower parts and an ear protector intermediate these parts, and an adjustable chin strap for interconnecting and varying the distance between the lower parts of the side panels, the improvement in combination therewith comprising; (a) a laceless rear band extending between and secured to said rear parts of said panels, said rear band being resiliently elastic in the transverse direction between said side panels, (b) at least one essentially inelastic belt means having one end secured to a first of said side panels and a remote end extendable to the second of said side panels, (c) first fastener means for releasably coupling said remote end of said belt means to said second side panel, said belt means adapted to overlie said rear band for varying and releasably fixing the distance between said side panels, (d) second belt means comprising a generally inelastic top belt having one end secured to said front panel and a remote end extendable rearward to engage said rear band, and (e) second fastener means for releasably coupling said remote end of the second belt means to said rear band for varying and releasably fixing the distance beween said front panel and said rear band.

2. In a headguard including a padded front panel having upper and lower parts, side panels extending rearward from the front panel, each side panel having upper, rear, and lower parts and an ear protector intermediate these parts, and an adjustable chin strap for interconnecting and varying the distance between the lower parts of the side panels, the improvement in combination therewith comprising; (a) a laceless rear band extending between and secured to said rear parts of said side panels, said rear band being resiliently elastic in the transverse direction between said side panels, (b) first belt means comprising a pair of essentially inelastic belts having first ends secured the two side panels respectively and remote ends respectively extendible to overlie said rear band and each other, (c) first fastener means for releasably coupling said remote ends of said belts to each other for varying and releasably fixing the distance between said side panels, (d) second belt means comprising a generally inelastic top belt having one end secured to said front panel and a remote end extendable rearward to engage said rear band, and (e) second fastener means for releasably coupling said remote end of said second belt means to said rear band for varying and releasably fixing the distance between said front panel and said rear band.

3. Apparatus according to claim 1 or 2 wherein said rear band comprises a continuous elastic fabric having opposite ends which are sewn to the rear parts of said side panels.

4. Apparatus according to claim 1 or 2 wherein said second fastener means comprises first and second mating VELCRO ®fasteners on said remote end of the top belt and said rear band respectively, whereby said top belt and rear band are releasably engageable.

5. Apparatus according to claim 1 or 2 wherein said top belt further comprises a pair of arms extending in opposite directions to and fixedly engaging the upper parts of said side panels respectively, said top belt and arms defining a cross-shaped web that is flexible and relatively inelastic.

6. Apparatus according to claim 1 or 2 wherein said rear band has height perpendicular to said transverse direction, of at least four inches.

7. Apparatus according to claim 1 or 2 wherein said first fastener means comprises first and second mating VELCRO ®fasteners on said remote ends of said belts respectively of said first belt means.

* * * * *

UNITED STATES PATENT AND TRADEMARK OFFICE

CERTIFICATE OF CORRECTION

PATENT NO. : 4,222,122

DATED : September 16, 1980

INVENTOR(S) : John L. Toms

It is certified that error appears in the above-identified patent and that said Letters Patent are hereby corrected as shown below:

Column 1, line 8, omit "collage" and insert --college--.

Column 4, line 40, omit "next" and insert --Next,--

Column 4, lines 43-44, omit "cucumferential" and insert --circumferential--.

Signed and Sealed this

*Thirteenth* Day of *January 1981*

[SEAL]

*Attest:*

SIDNEY A. DIAMOND

*Attesting Officer*

*Commissioner of Patents and Trademarks*